US007163527B2

(12) United States Patent
Ahlström et al.

(10) Patent No.: US 7,163,527 B2
(45) **Date of Patent: *Jan. 16, 2007**

(54) EASILY CARRIED EYE RINSING DEVICE

(75) Inventors: Tom Ahlström, Lidingö (SE); Hans Ehrich, Stockholm (SE); Jochen Ratjen, Stockholm (SE)

(73) Assignee: Cederroth International AB, Upplands Vasby (SE)

( * ) Notice: Subject to any disclaimer, the term of this patent is extended or adjusted under 35 U.S.C. 154(b) by 310 days.

This patent is subject to a terminal disclaimer.

(21) Appl. No.: 10/343,904

(22) PCT Filed: Oct. 16, 2001

(86) PCT No.: PCT/SE01/02248

§ 371 (c)(1),
(2), (4) Date: Jun. 10, 2003

(87) PCT Pub. No.: WO02/32371

PCT Pub. Date: Apr. 25, 2002

(65) Prior Publication Data

US 2005/0261640 A1 Nov. 24, 2005

(30) Foreign Application Priority Data

Oct. 16, 2000 (SE) ..... 0003731

(51) Int. Cl.
*A61H 35/02* (2006.01)
*B65D 49/12* (2006.01)

(52) U.S. Cl. ..... 604/301; 215/48; 215/49

(58) Field of Classification Search ..... 604/1–3, 604/289–90, 294–302, 310; 222/420, 541.1–541.9; 215/47–49

See application file for complete search history.

(56) References Cited

U.S. PATENT DOCUMENTS

| | | | | |
|---|---|---|---|---|
| 1,623,454 | A * | 4/1927 | Wilson | 604/301 |
| 3,945,381 | A | 3/1976 | Silver | 128/249 |
| 4,981,479 | A * | 1/1991 | Py | 604/302 |
| 6,164,450 | A * | 12/2000 | Benedetti | 206/570 |
| D467,108 | S | 12/2002 | Ahlström et al. | D6/545 |
| 6,540,726 | B1 * | 4/2003 | Follman et al. | 604/294 |

FOREIGN PATENT DOCUMENTS

| | | |
|---|---|---|
| EP | 0 998 895 A1 | 5/2000 |
| FR | 2659297 | 9/1991 |
| GB | 2392151 A * | 2/2004 |

* cited by examiner

*Primary Examiner*—Karin M. Reichle
(74) *Attorney, Agent, or Firm*—Alfred J. Mangels

(57) ABSTRACT

An easily carried eye rinsing device in the form of a flask containing an eye rinsing liquid. The flask is sealed by a closure element that projects up from a future opening of the flask. An eye cup surrounds the closure element and a sleeve surrounds the eye cup. The sleeve is non-rotatably connected with the closure element.

9 Claims, 2 Drawing Sheets

EASILY CARRIED EYE RINSING DEVICE

BACKGROUND OF THE INVENTION

1. Field of the Invention

The present invention relates to an easily carried eye rinsing device. By carried is meant that it can conveniently be carried about one's person, for instance.

2. Description of the Related Art

A number of different eye rinsing devices, which include flasks containing eye rinsing liquid for use in acute circumstances and even in other circumstances, are known to the art. These flasks are often placed in a holder and removed therefrom when needed, so that certain flasks are opened as they are taken from the holder. Such flasks are often equipped with an eye cup into which liquid runs from the flask.

There exists a need of such flasks that can be carried in the pocket of a garment, in a tool box, or carried about one's person in some other way.

It is desired with flasks of this nature that the eye cup and surrounding area are free from contaminants, such as dirt, so that no contaminants will enter the eyes of a user.

It is also desired that the flask can be opened and made ready for use with a simple hand manipulation.

It is also desired that it shall be impossible to reseal the flask. Resealing of an opened flask would mean that if the contents of the flask have become contaminated and then later used to rinse the eyes of the user, the contaminants might well affect the eye's of the user detrimentally.

Flasks constructed in accordance with known technology do not satisfy all of these desiderata at one and the same time.

Accordingly, the present invention relates to a flask whose eye cup is protected, which can be easily opened, and which cannot be re-sealed.

SUMMARY OF THE INVENTION

The present invention thus relates to an easily carried eye rinsing device. The device includes a flask which contains an eye rinsing liquid and that is closed by a closure element that projects up from a future opening of the flask. The flask further includes an eye cup that surrounds the closure element. The eye cup is surrounded by a sleeve that is non-rotatably connected to the closure element.

BRIEF DESCRIPTION OF THE DRAWINGS

The invention will now be described in more detail with reference to an exemplifying embodiment thereof, and also with reference to the accompanying drawings, in which.

DESCRIPTION OF THE PREFERRED EMBODIMENTS

Figure 1:
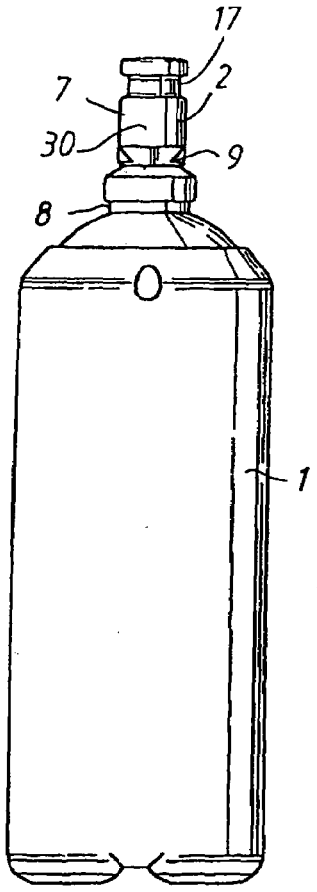
FIG. 1 is a side view of an inventive flask.

FIG. 1 shows an eye rinsing device in the form of a flask 1 that contains an eye rinsing liquid and that is sealed by a closure element 2 which projects up from the future flask opening. The flask is also fitted with an eye cup 3.

Figure 5:
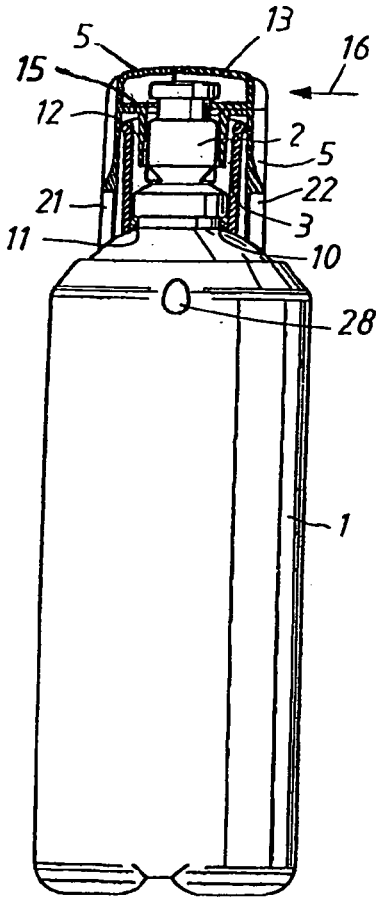
FIG. 5 is a cross-sectional view taken on the line 5—5 of FIG. 3, rotated 180°.
Figure 7:
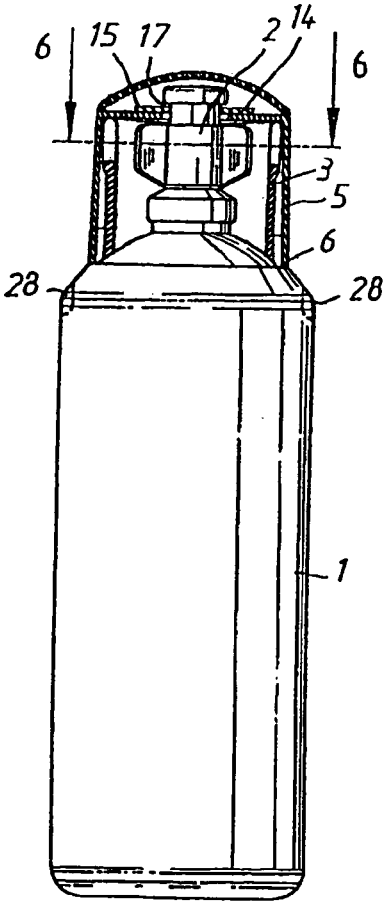
FIG. 7 is a side view of an inventive flask including a partial cross-sectional view, and taken on the line 7—7 of FIG. 4 and rotated 180°.
Figure 6:
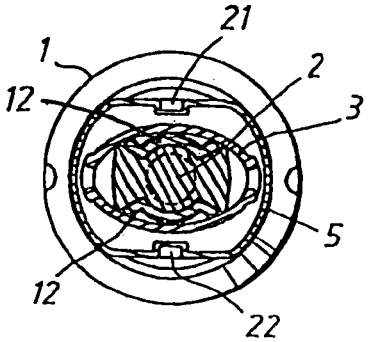
FIG. 6 is a cross-sectional view taken on the line 6—6 of FIG. 7.

According to the invention, the eye cup 3 is located around the closure element 2, see FIGS. 5, 6 and 7.

According to the invention, the device also includes a sleeve 5 that surrounds the eye cup 3. The lower part 6 of the sleeve 5 lies around and against the flask, as shown in FIG. 7. This means that the eye cup will be protected by the sleeve against contamination, for instance by dust and dirt. The sleeve 5 is non-rotatably fixed in the upper part 7 of the closure element 2.

Figure 2:
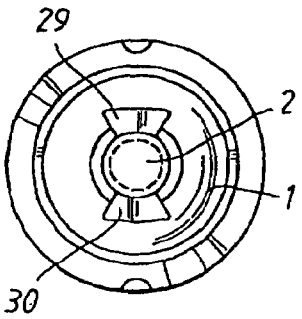
FIG. 2 is a top view of the flask shown in FIG. 1.

According to one preferred embodiment of the invention, the closure element 2 is not axially symmetrical around the longitudinal axis of the flask. In the illustrated embodiment of the invention, the closure element 2 at the upper part 7 includes two wings 29, 30 (see FIG. 2) that widen. However, the closure element may have a square cross-sectional shape instead. The closure element may, of course, have another non-symmetrical form, such that the flask will be opened when the sleeve, and therewith the closure element, is/are rotated relative to the flask. The closure element 2 includes a waist 8 located beneath a future opening 9, as shown in FIG. 1. The lower portion of the eye cup 3 engages in said waist, as evident from FIG. 5, by virtue of projections 10, 11 provided on the eye cup. The eye cup is thus snapped firmly into the waist region 8 of the flask 1. Moreover, an inner part of the sleeve 5 engages around the non-symmetrical upper part 7 of the closure element 2. This will best be seen from FIGS. 5, 6, and 7, which show that the upper part of the sleeve 5 includes inner, downwardly projecting correspondingly-shaped, generally portions 12 that engage with the axially asymmetric upper part 7 of the closure element. The sleeve 5 is also connected with the closure element 2 by means of a fastener element 13 (see FIG. 4) that co-acts with said closure element. The sleeve 5 is preferably connected at the upper part 7 of the closure element 2.

Alternatively this connection can be achieved by an element that grips in the lower part of the closure element 2.

The provision of two widening wings 29,30 on the closure element enables said tubular part to engage effectively with the closure element.

Figure 4:
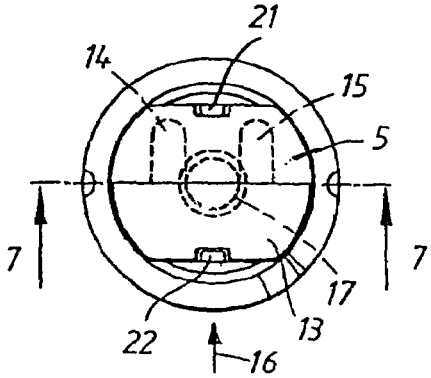
FIG. 4 is a top view of a flask according to FIG. 3, rotated 180°.

The fastener element 13 is generally semi-circular in shape and includes two tongues 14, 15, as shown in FIG. 4. The outer shape of the fastener element 13 corresponds in general to the shape of the uppermost part of the sleeve 5. When the fastener element 13 has been inserted to its end position in said sleeve 5, in the direction of arrow 16 in FIGS. 4 and 5, the sleeve and the fastener element will form a smooth and even unit.

The upper part 7 of the closure element 2 includes a peripherally extending recess 17. When the fastener element 13 is inserted into the sleeve, the tongues 14, 15 will lie in abutment with the recess 17, as shown in FIGS. 4, 5, and 7, The sleeve 5 is thereby firmly seated on the flask.

The flask 1 is thus provided with an eye cup 3 that is firmly seated on the flask, and a sleeve 5 which is non-rotatably secured in the flask when the flask has not been used.

Figure 3:
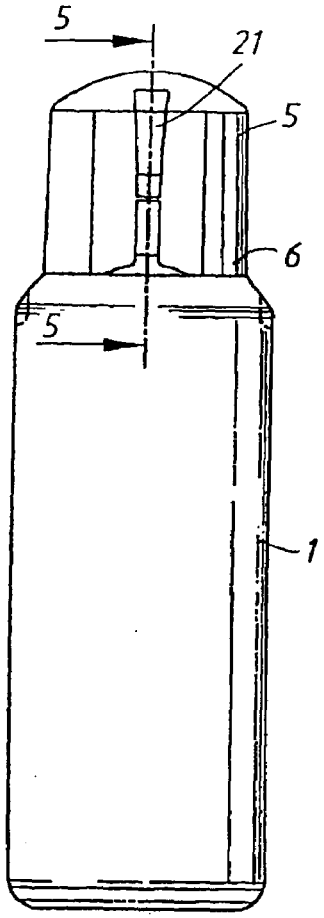
FIG. 3 is a side view of an inventive flask shown in FIG. 1 when provided with a sleeve and rotated 90°.

The flask is produced in a first step in the form of the unit shown in FIG. 1. The flask is filled with an eye rinsing liquid during manufacture of the flask and then provided with the eye cup 3, whereafter the sleeve 5 is fitted and fastened by means of the fastener element 13, said flask then having the form shown in FIG. 3.

When the flask is to be opened, the flask 1 is rotated relative to the sleeve 5, thereby breaking-off the closure element 2 at the future flask opening 9. The sleeve 5 and the upper part 7 of the closure element 2, which is firmly seated in the sleeve, are thus loosened automatically as the flask is rotated. What remains is the flask 1 with the eye cup 3 attached thereto. The eye cup 3 is then placed over the eye of the user and rinsing liquid flows from the flask when it is turned upside down. The rinsing liquid drains away via V-shaped channels in the short sides of the eye cup:

Although the sleeve 5 and that part of the closure element 2 which accompanies the sleeve can be placed back on the flask, it cannot be fastened at said part of the closure element that remains on the flask. Neither can the sleeve be fastened to the eye cup.

This embodiment prevents an open flask from being resealed.

The flask 1, the eye cup 3, and the sleeve 5 are formed from an appropriate plastic material.

It will be evident that the inventive device fulfils all of the desiderata recited in the introduction.

Although the invention has been described with reference to a number of exemplifying embodiments thereof, it will be apparent to one skilled in this art that the flask can be modified with respect to its structural design.

Consequently, the present; invention shall not be considered restricted to the aforedescribed and illustrated exemplifying embodiments, since variations can be made within the scope of the accompanying claims.

What is claimed is:

1. An easily carried eye rinsing device, said eye rinsing device comprising: a flask containing an eye rinsing liquid, wherein the flask is sealed closed by an integrally formed closure element that prevents liquid flow from the flask and that projects up from a future opening of the flask, an eye cup carried by the flask, wherein the eye cup surrounds the closure element, a sleeve surrounding the eye cup and non-rotatably connected with the closure element, and wherein when the flask is turned by twisting relative to the sleeve to separate it from the sleeve during use, the closure element that projects up from the future opening is non-resealably separated from the flask to provide the opening for permitting flow of eye rinsing liquid from the flask.

2. The device according to claim 1, wherein the closure element is non-symmetrical about a longitudinal axis of the flask, an inner part of the sleeve engages an axially asymmetrical part of the closure element, and wherein the sleeve is connected with an upper part of the closure element by a fastener element that co-acts with said upper part.

3. The device according to claim 2, wherein the asymmetrical part of the closure element includes at least one laterally-extending wing.

4. The device according to claim 3, wherein the laterally-extending wing widens in a laterally outward direction.

5. The device according to claim 2, wherein the inner part of the sleeve is a pair of opposed, elements shaped correspondingly to the axially asymmetrical part.

6. The device according to claim 2, wherein the fastener element includes a pair of laterally-extending tongues that are each received in a recess formed in the closure element.

7. The device according to claim 6, wherein the recess is an annular recess.

8. The device according to claim 1, wherein the closure element includes a waist situated beneath said future opening, and wherein a lower part of the eye cup is received in said waist.

9. The device according to claim 1, wherein a lower part of the sleeve lies around and against the flask.

* * * * *